US011826603B2

(12) United States Patent
Alvarez

(10) Patent No.: US 11,826,603 B2
(45) Date of Patent: Nov. 28, 2023

(54) SYSTEMS AND METHODS FOR PASSIVE, ACTIVE, AND RESISTANCE RANGE OF MOTION AND STRETCHING APPARATUS

(71) Applicant: Jamie Alvarez, Colorado City, TX (US)

(72) Inventor: Jamie Alvarez, Colorado City, TX (US)

( * ) Notice: Subject to any disclaimer, the term of this patent is extended or adjusted under 35 U.S.C. 154(b) by 673 days.

(21) Appl. No.: 16/867,621

(22) Filed: May 6, 2020

(65) Prior Publication Data

US 2020/0376322 A1 Dec. 3, 2020

Related U.S. Application Data

(63) Continuation of application No. 16/428,030, filed on May 31, 2019, now Pat. No. 10,682,543.

(51) Int. Cl.
*A63B 21/00* (2006.01)
*A63B 21/005* (2006.01)
(Continued)

(52) U.S. Cl.
CPC ..... *A63B 21/4011* (2015.10); *A63B 21/0057* (2013.01); *A63B 21/00178* (2013.01);
(Continued)

(58) Field of Classification Search
CPC .. A61H 1/00; A61H 1/024; A61H 2201/1207; A61H 2201/1642;
(Continued)

(56) References Cited

U.S. PATENT DOCUMENTS 3,632,480 A 1/1972 Surprenant
4,214,577 A 7/1980 Hoy
(Continued)

FOREIGN PATENT DOCUMENTS

CN 106137708 A 11/2016
CN 106473902 A 3/2017
(Continued)

OTHER PUBLICATIONS https://www.alimed.com/comfy-spring-loaded-ankle-foot-orthosis.html?gclid=EAIaIQobChMIuNvi9ZzC3QIVxLjACh1wPg-AEAQYBCABEgLUJ_D_BWE (last visited on Jun. 11, 2019).
(Continued)

*Primary Examiner* — Joshua Lee
(74) *Attorney, Agent, or Firm* — RegitzMauck PLLC; Dustin Mauck; Mike Regitz

(57) ABSTRACT

The present invention includes a rehabilitation apparatus that can assist a patient that has been impaired, injured/traumatized, or subject to degenerative conditions in his or her lower limbs. The apparatus may be designed to exercise the extension and flexion movements for a patient's leg after knee surgery. A thigh support link may be connected to an upper leg link, which is connected to a lower leg link for supporting the patient's leg during the extension and flexion range of movements. A foot plate with wheels may be connected to the lower leg link, and the wheels enable the foot plate to slide along a base as the patient moves in both directions. A sled or connector provides a flexible connection between the thigh support link and the base, which allows the thigh support link to travel along the base in conjunction with the foot plate wheels. The present invention provides adjustable, constant resistance as the extension and flexion exercises are done. In some embodiments, the resistance may be different for the extension and flexion ranges of motion. The resistance may be applied through the connection of the sled or connector to the base. This can be done with direct or magnetic resistance mechanisms. In one embodiment, one or more b-motors or magnetic clutches are used to provide magnetic resistance.

18 Claims, 12 Drawing Sheets

(51) Int. Cl.
*A63B 24/00* (2006.01)
*A63B 22/00* (2006.01)

(52) U.S. Cl.
CPC ..... *A63B 21/4034* (2015.10); *A63B 21/4047* (2015.10); *A63B 22/00* (2013.01); *A63B 24/0087* (2013.01); *A63B 2022/0094* (2013.01)

(58) Field of Classification Search
CPC .... A61H 2201/1669; A61H 2203/0431; A61H 2203/0456; A61H 2205/102; A61H 2209/00; A63B 21/00178; A63B 21/00192; A63B 21/0057; A63B 21/0058; A63B 21/008; A63B 21/225; A63B 21/4011; A63B 21/4034; A63B 21/4045; A63B 21/4047; A63B 22/00; A63B 24/0087; A63B 71/0622; A63B 2022/0094; A63B 2071/0675; A63B 2208/0228; A63B 2208/0252
See application file for complete search history.

(56) References Cited

U.S. PATENT DOCUMENTS

| | | | | |
|---|---|---|---|---|
| 4,229,001 | A | 10/1980 | Roman | |
| 4,323,060 | A | 4/1982 | Pecheux | |
| 4,566,440 | A | 1/1986 | Berner | |
| 4,679,786 | A | 7/1987 | Rodgers | |
| 4,922,892 | A | 5/1990 | Akcelrod et al. | |
| 5,421,798 | A | 6/1995 | Bond et al. | |
| 5,569,120 | A * | 10/1996 | Anjanappa | A63B 24/00 482/4 |
| 5,583,403 | A * | 12/1996 | Anjanappa | A63B 24/00 318/471 |
| 5,860,941 | A | 1/1999 | Saringer et al. | |
| 6,224,521 | B1 | 5/2001 | Foucault | |
| 6,416,448 | B1 | 7/2002 | Hassler | |
| 6,520,892 | B1 | 2/2003 | Hassler | |
| 8,070,659 | B2 | 12/2011 | Gagnon | |
| 8,679,040 | B2 | 3/2014 | Horst | |
| 8,696,606 | B2 * | 4/2014 | Jacofsky | A61H 1/008 601/122 |
| 9,526,945 | B1 | 12/2016 | Edmondson | |
| 11,413,499 | B2 * | 8/2022 | Maroldi | A63B 21/0428 |
| 2011/0160625 | A1 | 6/2011 | Yefimov | |
| 2013/0211297 | A1 * | 8/2013 | Method | A61H 1/0237 601/34 |
| 2014/0094721 | A1 * | 4/2014 | Diallo | A63B 24/0087 601/5 |
| 2014/0200490 | A1 | 7/2014 | Kie | |
| 2015/0374572 | A1 | 12/2015 | Gilderman | |
| 2018/0177663 | A1 | 6/2018 | Branch et al. | |

FOREIGN PATENT DOCUMENTS

| | | | |
|---|---|---|---|
| CN | 106491308 | A | 3/2017 |
| EP | 230218 | A1 | 7/1987 |

OTHER PUBLICATIONS

"CPM Machine in Use," https://www.youtube.com/watch?v=OLvJwe5GAfg (last visited on Jun. 11, 2019). Shows a CPM machine in use.

* cited by examiner

SYSTEMS AND METHODS FOR PASSIVE, ACTIVE, AND RESISTANCE RANGE OF MOTION AND STRETCHING APPARATUS

PRIORITY CLAIM

This application claims priority to and is a continuation application of U.S. patent application Ser. No. 16/428,030 that was filed on May 31, 2019.

TECHNICAL FIELD

The present invention relates generally to an apparatus that assists with passive, active, and strength range of motion and stretching exercises for patients that have been impaired, suffered injury/trauma, or are subject to degenerative conditions and, more specifically, to an apparatus that allows a patient to exercise through ranges of motion for lower limbs.

BACKGROUND OF THE INVENTION

Injury, trauma, impairment, or post-surgery recovery is big business worldwide. As the population gets older, people tend to injure their knees, hips, shoulders, and other body parts, or these body parts deteriorate over time. Degenerative or arthritic issues may also lead to the deterioration of knees, hips, and shoulders. Often a patient must have surgery to improve the painful condition. Sometimes this can involve working on or repairing the affected area or even implanting a replacement knee or hip joint. After surgery, patients are required to treat and rehabilitate the areas of the body that were subjected to or affected by the operation. Ice, heat, or electrical stimulation to the affected area may be recommended for post-surgery treatment. In addition to this treatment, rehabilitation is crucial for recovery.

The knee or hip that was impaired, injured, or subject to surgery may need to be improved, exercised, and strengthened after surgery, including surrounding areas that control or influence the knee or hip. For example, if a patient's knee was operated on, then the patient may need to strengthen not only the knee, but the other muscles, tendons, and ligaments that interact with the knee, including the calf muscle, thigh muscle, anterior cruciate ligament (ACL), lateral cruciate ligament (LCL), patellar tendon, etc. Traditionally, surgeons would recommend a physical therapy plan for post-surgery recovery, which included visiting with a physical therapist that can move, adjust, stretch, and exercise the patients' muscles and joints according to the plan. However, this requires the patient to make an appointment and travel to the physical therapist's office for the appointment. Additionally, the physical therapist may have to assist with the exercises or stretching of the desired body parts. This can create scheduling conflicts and may limit the amount of therapy for the patient.

Conventionally, the physical therapist had to assist with the exercises or stretching of the desired body parts, which may lead to inconsistent repetitions and improper movements. For example, the physical therapist may apply a first resistance on one repetition and a different resistance on the next repetition, which could lead to inconsistent exercises. Further, the physical therapist may be performing improper ranges of motions that do not match up with the recommended physical therapy plan.

Physical therapists and patients also use apparatuses and devices to accomplish the recommended physical therapy after a surgery. A physical therapist's office can look similar to a gym with workout equipment and weights for stretching and exercise. However, these apparatuses and devices are expensive, bulky, and not always appropriate for physical therapy. Without significant supervision and assistance, the patient may use the equipment improperly, select the wrong resistance, or fail to use the recommended range of motion. Conventional apparatuses may provide the stretching component by putting the body part through a desired range of motion, or separately provide resistance to the body part, but a device that accomplishes both is desired. With post-surgery patients, consistent resistance and proper range of motion are crucial to recovery.

For operations on the knee, devices called continuous passive motion ("CPM") have been recently used for post-surgery rehabilitation. These devices are utilized to gently flex and extend the knee within the proper range of motion but fail to provide any resistance in this range of motion. While this device allows the patient to move his or her knee at home or in the hospital without the assistance of a physical therapist, this device simply passively moves the leg. Studies have shown that this device may be helpful right after surgery to improve range of motion but may not be helpful in the long run because the knee and the muscles surrounding it are not strengthened or exercised. The muscles can atrophy without this exercise and strengthening. A device that can be used in or outside of the physical therapist's office to improve range of motion and strengthen the desired area is needed. This type of apparatus would greatly improve and speed up the recovery process and can be used to strengthen the uninvolved leg.

BRIEF SUMMARY OF THE INVENTION

The present invention includes a rehabilitation apparatus that can assist a patient with impairment, injury, pre-surgery and/or post-surgery recovery. As discussed above, conventional machines or rehabilitation programs for post-surgery recovery fail to enhance the recovery process and speed up the recovery time. Simple flexing and stretching of the leg offer limited benefits to the patient, and machines that focus on one motion (extension or flexion), but not the other, miss the mark. A solution that can provide consistent resistance in both directions (extension and flexion) would provide a great benefit to the recovery process. This present invention offers a portable and mobile solution to the patient.

In some embodiments, the present invention may be designed to exercise the extension and flexion movements for a patient's leg after knee surgery. A thigh support link may be connected to an upper leg link, which is connected to a lower leg link for supporting the patient's leg during the extension and flexion range of movements. A foot plate with wheels is connected to the lower leg link, and the wheels enable the foot plate to slide along a base as the patient moves in both directions. A sled or connector provides a flexible connection between the thigh support link and the base, which allows the thigh support link to travel along the base in conjunction with the foot plate wheels. Strap or buckle mechanisms on the lower leg link and the upper leg link secure the patient's leg to the rehabilitation apparatus and may provide resistance for strengthening or resistance for stretching.

The present invention provides resistance as the extension and flexion exercises are done. The resistance may be applied through the connection of the sled or connector to the base. The resistance may also be applied through the connection of the foot plate to the base. Direct or magnetic resistance may be used to provide this resistance. One or more b-motors (with constant force spring) may be used to provide magnetic resistance. Magnetic clutches may also be used in the place of b-motors in the present invention. In a preferred embodiment, one b-motor is used to provide resistance to the sled or connector during extension and a separate b-motor is used to provide resistance to the sled or connector during flexion. One or more bands or belts may be used to connect the b-motor to the sled or connector. While some embodiments focus on magnetic resistance, brake based, direct-contact, or pneumatic resistance may be utilized in the present invention.

A magnetic compression component or clamp may be utilized to provide the magnetic resistance to the present invention. More specifically, this component creates a magnetic field that a metallic or magnetized band or belt travels through. The magnetic field created by the component can be adjusted by the user, which would adjust the magnetic resistance applied to the band or belt. In some embodiments, the magnetic compression component may comprise one or more magnets on one side of the band or belt and one or more oppositely-charged magnets on the other side of the band or belt. This way moving the magnets closer together or further apart would affect the magnetic field, and therefore, affect the resistance applied to the band or belt.

In some embodiments, a transfer mechanism is required to transfer from one b-motor to another b-motor (or magnetic clutch). For example, a first b-motor may be used for extension and when the patient reaches full extension, the first b-motor switches off and the second b-motor switches on for flexion. When the patient reaches full flexion, the second b-motor switches off and the first b-motor switches on again for extension. This transfer mechanism may turn on and off each b-motor in response to the patient's range of motion or may alternate between the first band or belt and the second band or belt in response to the patient's range of motion.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
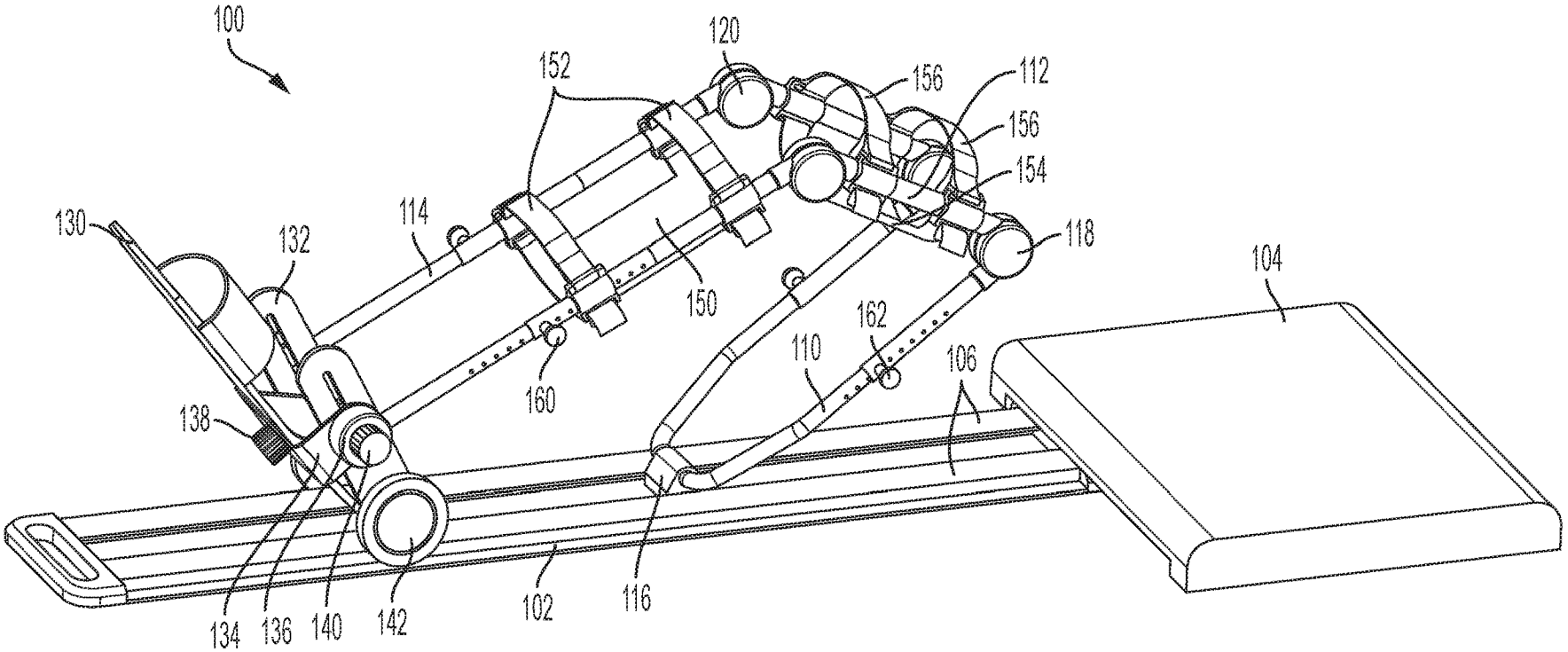
FIG. 1 shows a side view of rehabilitation apparatus according to embodiments of the invention.
Figure 2:
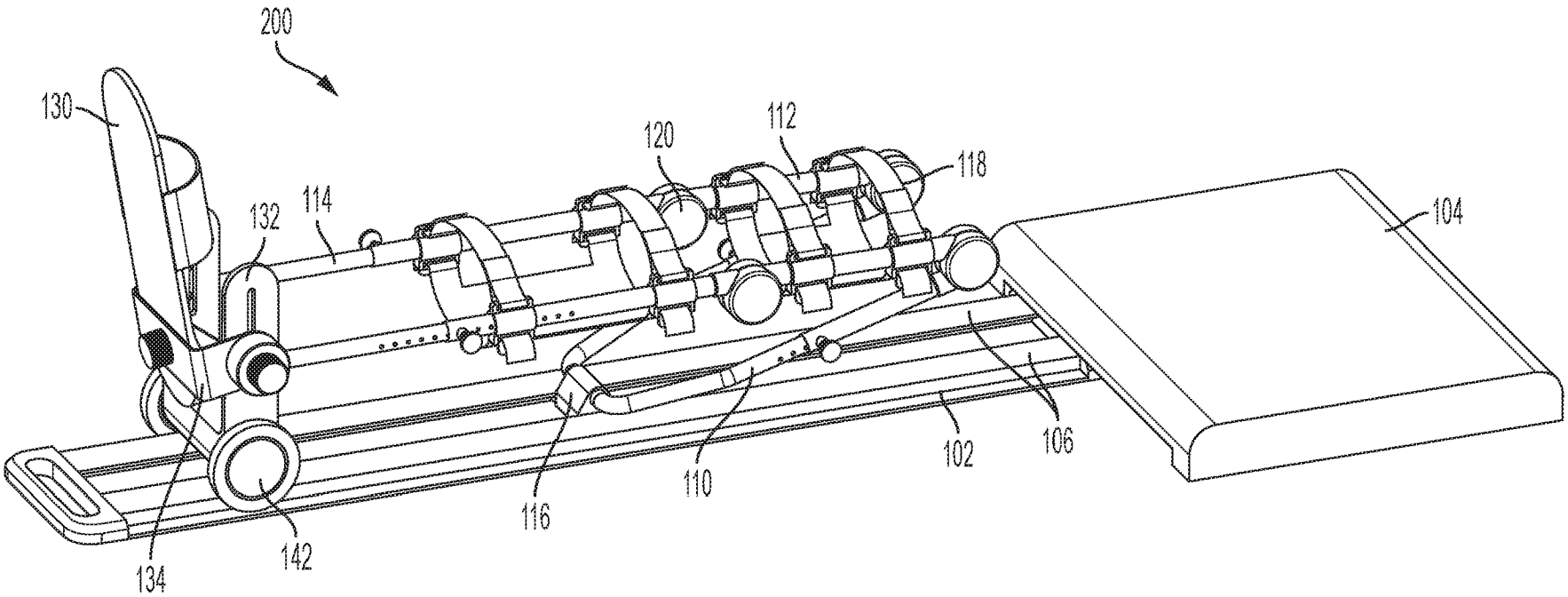
FIG. 2 shows a side view of a rehabilitation apparatus according to embodiments of the invention.

FIG. 1 shows a side view of a rehabilitation apparatus 100 according to embodiments of the present invention in a position where the user's knee (not shown) would be bent or flexed. FIG. 2 shows a side view of a rehabilitation apparatus 200 in a position where the user's knee would be extended. During operation, the rehabilitation apparatus 100 moves the user's leg through a range of motion from a flexed position to an extended position. As the user's leg moves through this range of motion, the user's foot (not shown) moves along a base 102 to achieve extension of the user's leg. The base 102 is connected to a housing 104 for the user to sit on or near while using the rehabilitation apparatus 100. In FIGS. 1 and 2, the base 102 is connected to the right side of housing 104 for the user to exercise his or her right leg. The base 102 can also be connected to the left side of housing 104 for the user to exercise his or her left leg.

A thigh support link 110, an upper leg link 112, and a lower leg link 114 combine to support the user's leg in the rehabilitation apparatus. These three links 110, 112, 114 have two portions (left and right) that are designed to be adjacent to opposite ends of the user's leg. A sled 116 connects the thigh support link 110 to the base 102. Other types of connectors can be used in place of the sled. The sled 116 contains one or more protrusions to fit into base rails 106, which are raised portions of the base 102. The base rails 106 may include indentions or apertures for the protrusions to fit in. The base 102 will be further described herein. In this configuration, the sled 116 can slide along the base 102 to enable the connected thigh support link 110 to slide along the base 102. In this embodiment, the thigh support link 110 fits within a hole or aperture in the sled 116 which enables it to move while the user's leg slides down the base 102 through a range of motion.

The thigh support link 110 is connected to the upper leg link 112 through one or more thigh pivots 118. The thigh pivots 118 provide a flexible connection enabling the thigh support link 110 and the upper leg link 112 to rotate through the range of motion of the user. The upper leg link 112 is connected to the lower leg link 114 through one or more knee pivots 120. The knee pivots 120 provide a flexible connection enabling the upper leg link 112 and the lower leg link 114 to rotate through a range of motion of the user. In this embodiment, the thigh pivots 118 and the knee pivots 120 are circular connectors, but other methods of connecting the thigh support link 110, the upper leg link 112, and the lower leg link 114 are within the scope of the present invention.

The lower leg link 114 connects to a foot plate 130 that supports the user's foot during operation. In this embodiment, a foot slider 132 and a foot cradle 134 provide the connection between the lower leg link 114 and the foot plate 130. A foot plate knob 138 allows the foot cradle 134 to move up and down the foot plate 130. This is an adjustment that can be made by the user. An ankle pivot 136 connects the foot cradle 134 to the foot slider 132 to enable the lower leg link 114 to rotate with respect to the foot plate 130 as the user moves through the range of motion. An ankle pivot knob 140 allows the user to adjust the foot slider 132 to move with respect to the lower leg link 114. At least one slider wheel 142 is connected to the foot slider 132 to enable the foot plate 130 to move while the user's leg slides down the base 102 through a range of motion. Accordingly, the slider wheel 142 slides along the base 102 during operation. While the sled 116 fits inside base rails 106, the slider wheel rolls down the length of the base 102. One or more springs (not shown) may be added to the connection of the foot cradle 134, ankle pivot 136, and ankle pivot knob 140 that allows the patient to activate the plantar flexion and dorsi flexion range of motions. More specifically, a coil spring or a spiral spring may enable the foot plate 130 to move back and forth to achieve this range of motion. The spring or springs may be included in the foot cradle 134. A double ring setup could be used to attach the foot slider 132 to the foot cradle 134, wherein the springs are incorporated in the foot cradle 134 or attached to the foot cradle 134 to allow the plantar flexion and dorsi flexion movements. The resistance provided may assist with deep vein thrombosis (DVT) prevention.

The rehabilitation apparatus 100 also has components to hold the user's leg in place during operation. A lower leg crossbar 150 straddles the two portions of the lower leg link 114 to provide support for the user's lower leg. An upper leg crossbar 154 straddles the two portions of the upper leg link 112 to provide support for the user's upper leg. During operation, the user's leg rests on the lower leg crossbar 150 and the upper leg crossbar 154. Adjustable straps 152 are designed to secure the user's lower leg to the lower leg crossbar 150 and the lower leg link 114. Adjustable straps 156 are designed to secure the user's upper leg to the upper leg crossbar 154 and the upper leg link 112. While crossbars 150, 154 and adjustable straps 152, 156 are shown in this embodiment, alternative methods of securing the user's leg to the lower leg link 114 and the upper leg link 112 are within the scope of the present invention. One or more adjustable knee straps (not shown) may be included to provide additional stretching and exercise for the user's knee and surrounding muscles, ligaments, and tendons. This adjustable knee strap may connect to (1) the lower leg crossbar 150 for exercises related to a connection below the knee, (2) a position on or near knee pivots 120 for exercises related to a connection at the knee, or (3) the upper leg crossbar 154 for exercises related to a connection above the user's knee. The connection of the adjustable knee strap could be configured to attach and detach from these locations of the rehabilitation apparatus 100 to enable three different types of knee movements by the user. The adjustable knee strap could be controlled by magnetic resistance as disclosed in FIG. 9 or other means of resistance disclosed herein (i.e., flywheel). Further, this adjustable knew strap could be manually controlled by the user. These three movements could provide additional stretching and exercise for the user.

In addition to the adjustable straps 152, 156 that account for the thickness of the user's leg, adjustment knobs 160, 162 may be used to account for the length of the user's legs. Lower leg adjustment knobs 160 can be adjusted by the user to increase or decrease the length of the lower leg link 114. Thigh support adjustment knobs 162 can be adjusted by the user to increase or decrease the length of the thigh support link 110. A taller user may need additional length for the lower leg link 114 and the thigh support link 110. Alternative methods for adjusting the length of the lower leg link 114 and the thigh support link 110 are within the scope of the present invention.

FIG. 2 shows the same rehabilitation apparatus 200 but in a position where the user's leg is extended. In this position, the sled 116 slid further down the base 102 on the base rails 106 and the space between the thigh support link 110 and the upper leg link 112 collapsed. The rotation of the thigh pivot 118 allows this movement. The slider wheel 142 also slid further down the base 102 and the upper leg link 112 and the lower leg link 114 create an almost straight line for extension of the user's knee. The rotation of the knee pivot 120 allows for this movement. The flexibility between the foot slider 132 and the foot cradle 134 enables the foot plate 130 to move in conjunction with the user's knee during this extension exercise. In some embodiments, blocks or adjustable restraints can be used to limit the extension and flexion motions of the user. For example, a first adjustable block could be applied to limit the range of motion for extension and a second adjustable block could be applied to limit the range of motion for flexion. This may be prescribed for patients that must limit the full range of motion due to the impairment, injury, or surgery. Adjustable restraints could also be used and adjusted to account for a growing range of motion.

During this movement, the rehabilitation apparatus 100, 200 not only takes the user's leg through this range of motion, but it also provides resistance to enhance the benefit to the user. This resistance can be provided through many different resistance mechanisms (i.e., brake based, direct-contact, weight based, magnetic resistance, pneumatic). For example, brake or brake-like components could be added to the sled 116, slider wheels 142, and/or base rails 106 to provide brake-based resistance. Brake-based resistance (flywheel, etc.) is similar to what is used in stationary bicycles. Similarly, direct-contact components could be added to the sled 116, slider wheels 142, and/or base rails 106 to provide direct-contact resistance. This could be done with brake-like components that use friction to provide the resistance. Weights may be added to the sled 116, slider wheels 142, lower leg link 114, upper leg link 112, or thigh support link 110 to provide adjustable resistance. Pneumatic actuators with corresponding piston/cylinder sets may also be used to provide the necessary resistance. More specifically, pneumatic actuators may be added to the sled 116, slider wheels 142, and/or base rails to provide adjustable resistance. As the piston/cylinder sets are filled up with additional air, the pressure increases and the corresponding resistance increases. Exercise bands or tubing could also be used to provide the resistance. In some embodiments, exercise bands or tubing may be used to provide additional resistance towards the end of the range of motion (i.e., bands are activated towards the end of the range of motion for additional strength training). While the present invention includes all of these manners of resistance, in a preferred embodiment magnetic resistance is used to provide the adjustable resistance.

Figure 3A:
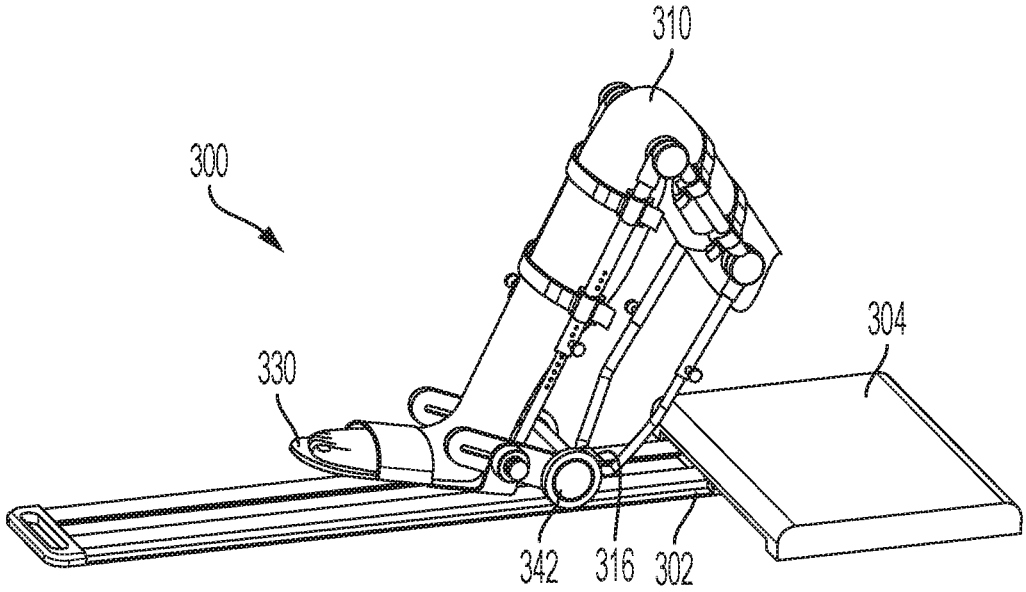
FIGS. 3A, 3B, 3C, 3D, and 3E show a rehabilitation apparatus during operation according to embodiments of the invention.
Figure 3B:
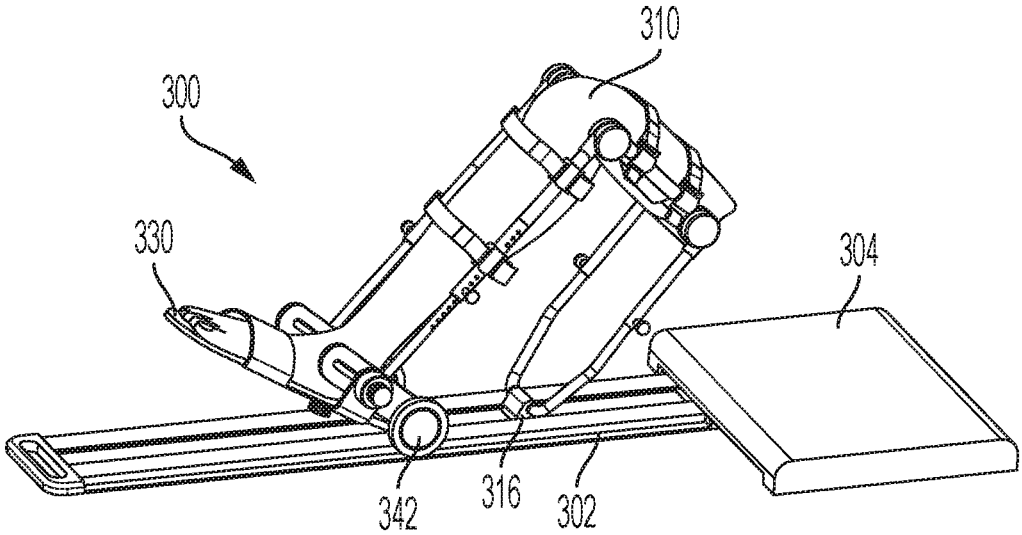
Figure 3C:
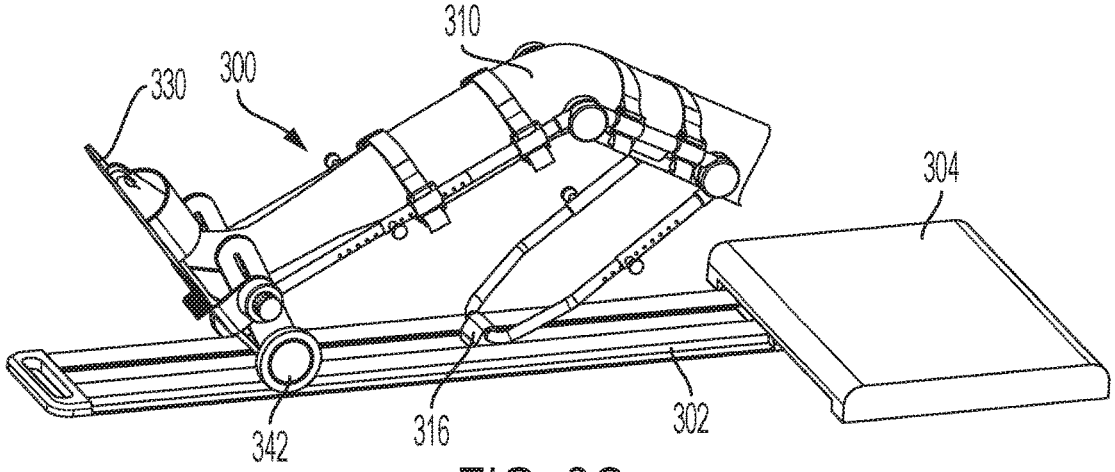
Figure 3D:
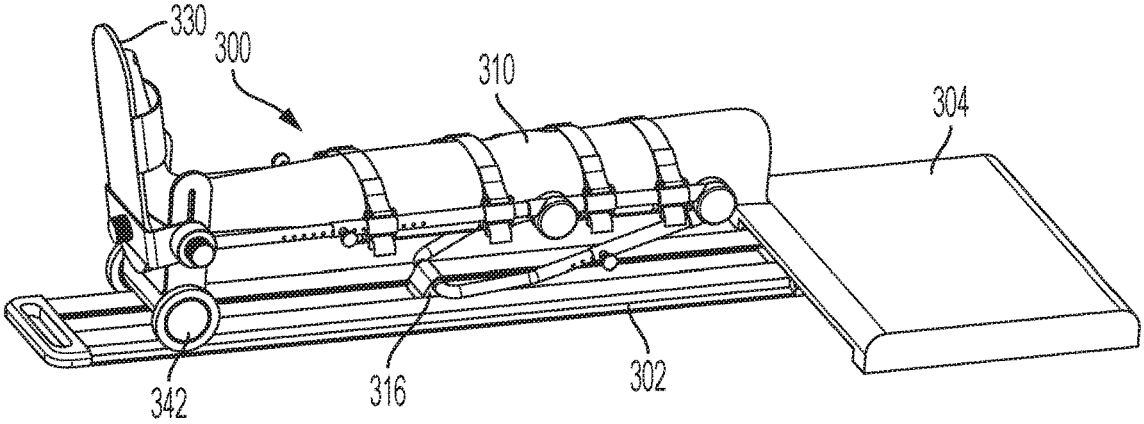
Figure 3E:
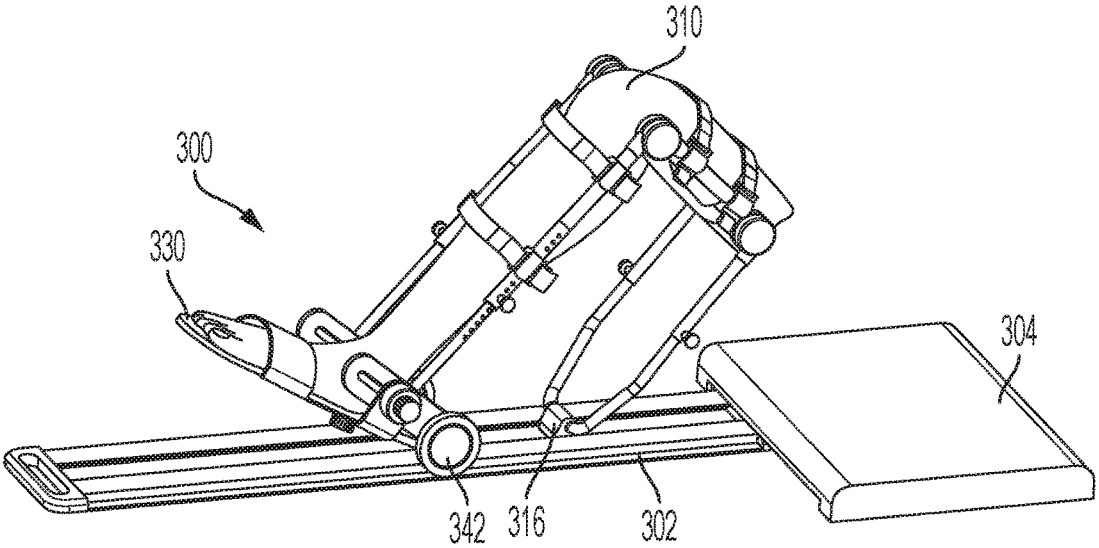

FIGS. 3A, 3B, 3C, 3D, and 3E show a rehabilitation apparatus 300 during operation. A user or patient 310 uses the rehabilitation apparatus to go through a full range of motion for the user's knee and surrounding muscles, tendons, and ligaments. In FIG. 3A, the user's knee is flexed and his or her foot is close to flat on a base 302. In FIG. 3B, the user's knee begins to extend, and the toes of the user's foot begin to rise in conjunction with a foot plate 330. In FIG. 3C, the user's knee further extends, and the toes of the user's foot begin to rise. During this entire exercise and movement, the user remains seated, supine, or long sitting on or near a housing 304. In FIG. 3D, the user's knee and leg are fully extended, and the toes of the user are pointing straight up. FIGS. 3A-3D show the full range of motion of the rehabilitation apparatus 300 from the user's knee being fully extended (FIG. 3D) to the user's knee fully flexed (FIG. 3A). Extension and flexion of the knee are the two motions achieved by the rehabilitation apparatus 300. Then the user's knee begins to flex back to the bent position (FIG. 3E). In some embodiments, the foot plate and corresponding components may enable additional exercise through lifting the foot plate at full extension. Accordingly, the foot plate and connected slider wheels could be lifted up from the apparatus 100 and then placed back down to provide additional exercise and stretching.

During operation, slider wheels 342 move up and down the base 302 to achieve the desired range of motion. The slider wheels 342 are furthest away from the user 310 in the extended position (FIG. 3D) and are closest to the user 310 in the flexed position (FIG. 3A). A sled 316 also moves up and down the base 302 in conjunction with the slider wheels 342 to achieve the desired range of motion. The sled 316 is furthest away from the user 310 in the extended position (FIG. 3D) and is closest to the user 310 in the flexed position (FIG. 3A). The remaining components of the rehabilitation apparatus 300 are designed to flexibly move in conjunction with the user's range of motion. In this manner, the user 310 not only gets the range of motion exercises and stretching but can get resistance training through providing resistance to the movement of the slider wheels 342 and/or the sled 316.

Movement of the slider wheels 342 and sled 316 illustrate why it can be difficult to provide resistance with traditional weights or bands. First, weights or weighted components can be difficult to add to this apparatus because the specific customized resistance should be applied for both the extension movements and the flexion movements. Traditional weights or machines that use weights are primarily used for one range of motion (extension or flexion), but not both ranges of motion. Leg extensions involves pushing the weights out, while machines that focus on flexion would provide weight for the flexing of the legs. Elastic bands or workout bands with inherent resistance may not work well with this device because the resistance or pressure increases sharply as the bands expand. Thus, the largest resistance exists at full extension because the foot plate 330 is furthest away from the sled 316 or the housing 304. Then the resistance begins to disappear during flexion as the band contracts and the foot plate 330 moves closer to the sled 316 or the housing 304. In contrast to consistent resistance, the use of bands may create a varying resistance through the full range of motion. However, exercise bands or tubing may be used to contribute the resistance provided.

The knee is the largest and most complex joint in the body and is commonly injured due to the weight and movement that it must support. The knee must support the body in an upright position, assist with lowering and raising the body, provide stability, absorb the pressure applied to the legs, and propel the body forward through walking or running. This rehabilitation apparatus 100 is designed to facilitate, exercise, and work the muscles involved with extension and flexion of the knee. The quadricep muscles comprise a four-muscle group at the front of the thigh (rectus femoris, vastus medialis, vastus intermedius, and vastus lateralis) that primarily perform the work for extension of the knee. The hamstring muscles comprise a three-muscle group at the back of thigh (biceps femoris, semimembranosus, and semitendinosus) that primarily perform the work for flexion of the knee. A large muscle in the calf (gastrocnemius) is also responsible for flexing the knee. The quadricep, hamstring, and calf muscles improve in strength and flexibility through the use of this apparatus. The ranges of motion disclosed above are designed to take the patient through the primary leg movements involved with walking or running.

The rehabilitation apparatus 100 can also improve the flexibility and strength of the cartilage, ligaments, and tendons that surround and support the knee. Most severe knee injuries involve the straining, ripping, tearing, or detaching of the ligaments and tendons of the knee. Injuries to the ACL (anterior cruciate ligament), MCL (medial collateral ligament), PCL (posterior cruciate ligament), LCL (lateral collateral ligament), lateral meniscus, and medial meniscus are common in athletes or other individuals that pivot or change direction. Ripping or tearing the patellar tendon, which covers the knee-cap, can also lead surgery. Stretching and strengthening these repaired tendons and ligaments is crucial to recovery. This apparatus can assist in making those repaired ligaments and tendons stronger than they were before the injury or condition. This is why providing custom, specific, and continuous resistance during these movements is crucial to recovery of the patient. These muscles, cartilage, ligaments, and tendons must be strengthened to avoid future injury.

Additionally, adjusting the ranges of motion may be desired to further work on specific areas of the leg or knee. For example, securing the patient's leg in the rehabilitation apparatus 100 slightly off center could exercise repaired ligaments that prevent certain side to side or back and forth movements of the patient's leg. In some embodiments, the configuration of the base or the connection between the housing the base could allow for off-center ranges of motion of the patient's leg, which could exercise these repaired ligaments. In other embodiments, the rehabilitation apparatus 100 may be configured for other body parts or ranges of motion. A similar apparatus could be used for stretching or exercising the ankle or achilles tendon in response to a surgery. The hip is another joint that requires extensive post-surgery physical therapy, so an apparatus could be designed to track ranges of motion related to the hip and the muscles, ligaments, and tendons surrounding the hip. The present invention could be adapted for most ranges of motion that are part of a physical therapy plan.

Figure 4:
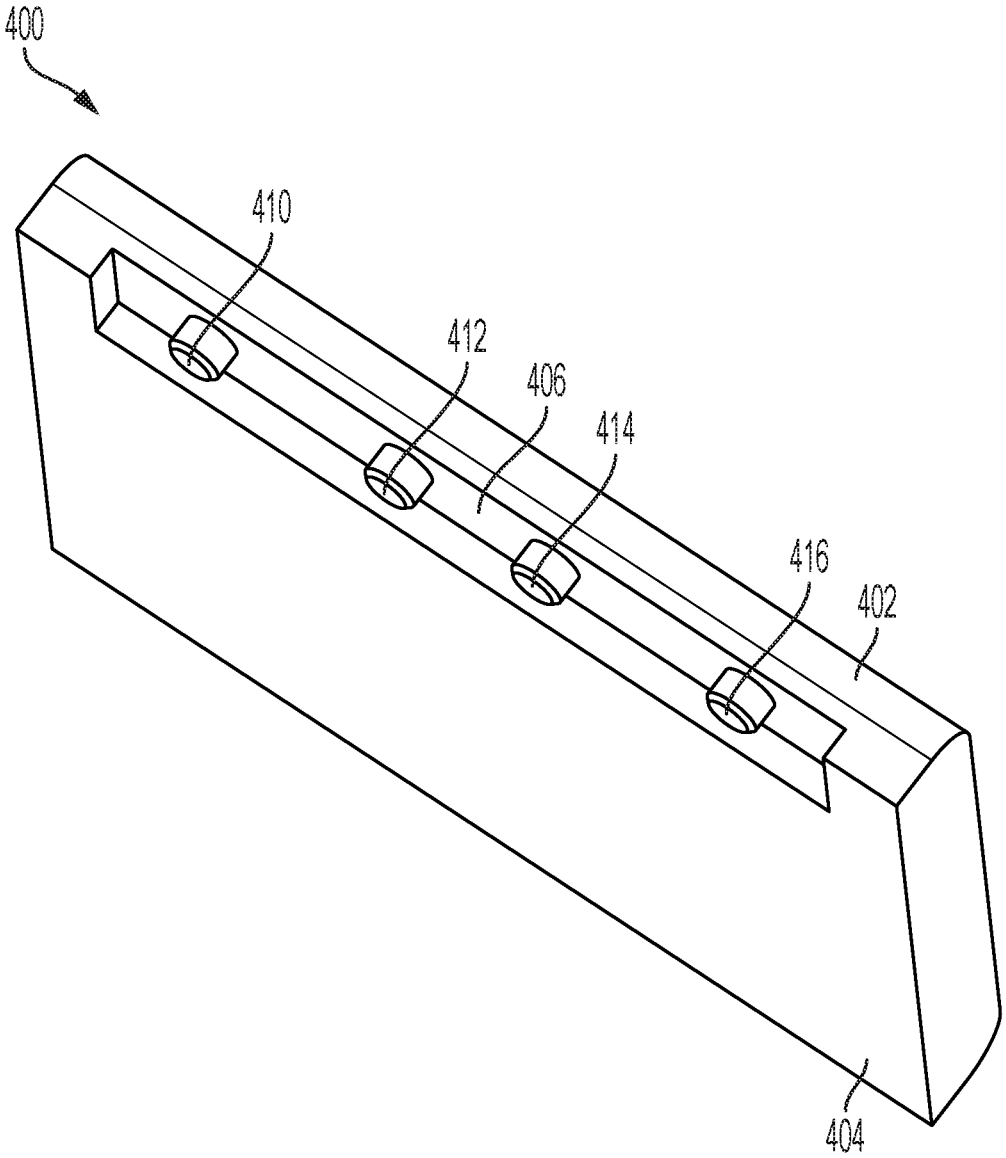
FIG. 4 shows a perspective view of a housing according to embodiments of the invention.
Figure 5A:
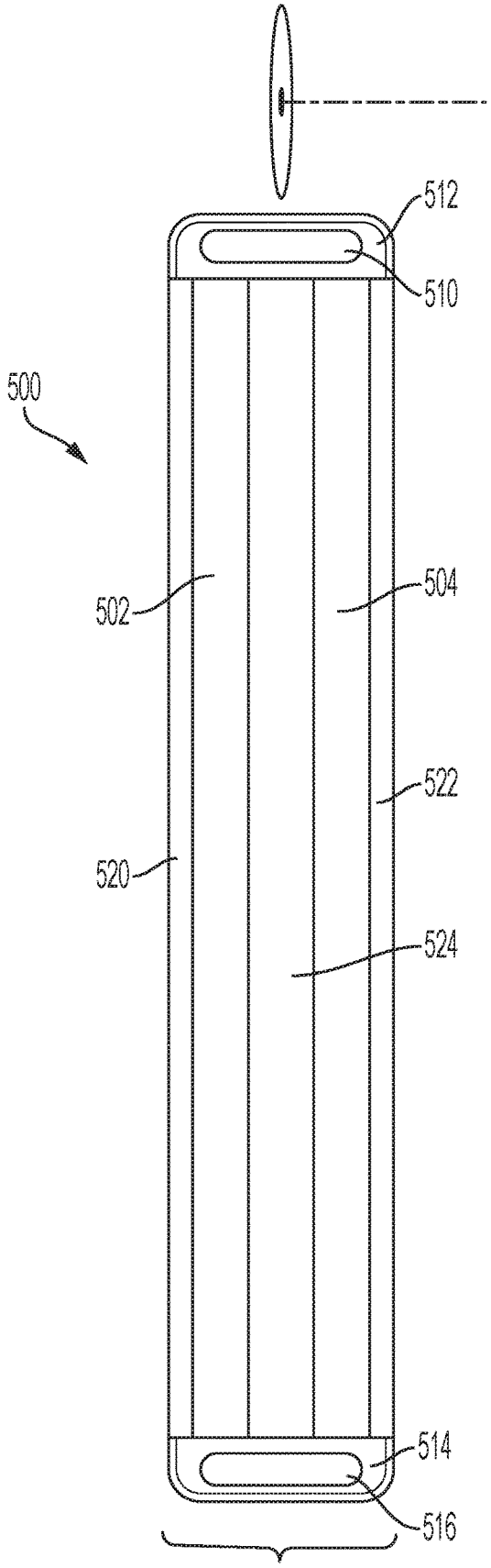
FIGS. 5A and 5B show alternative views of a base according to embodiments of the invention.
Figure 5B:
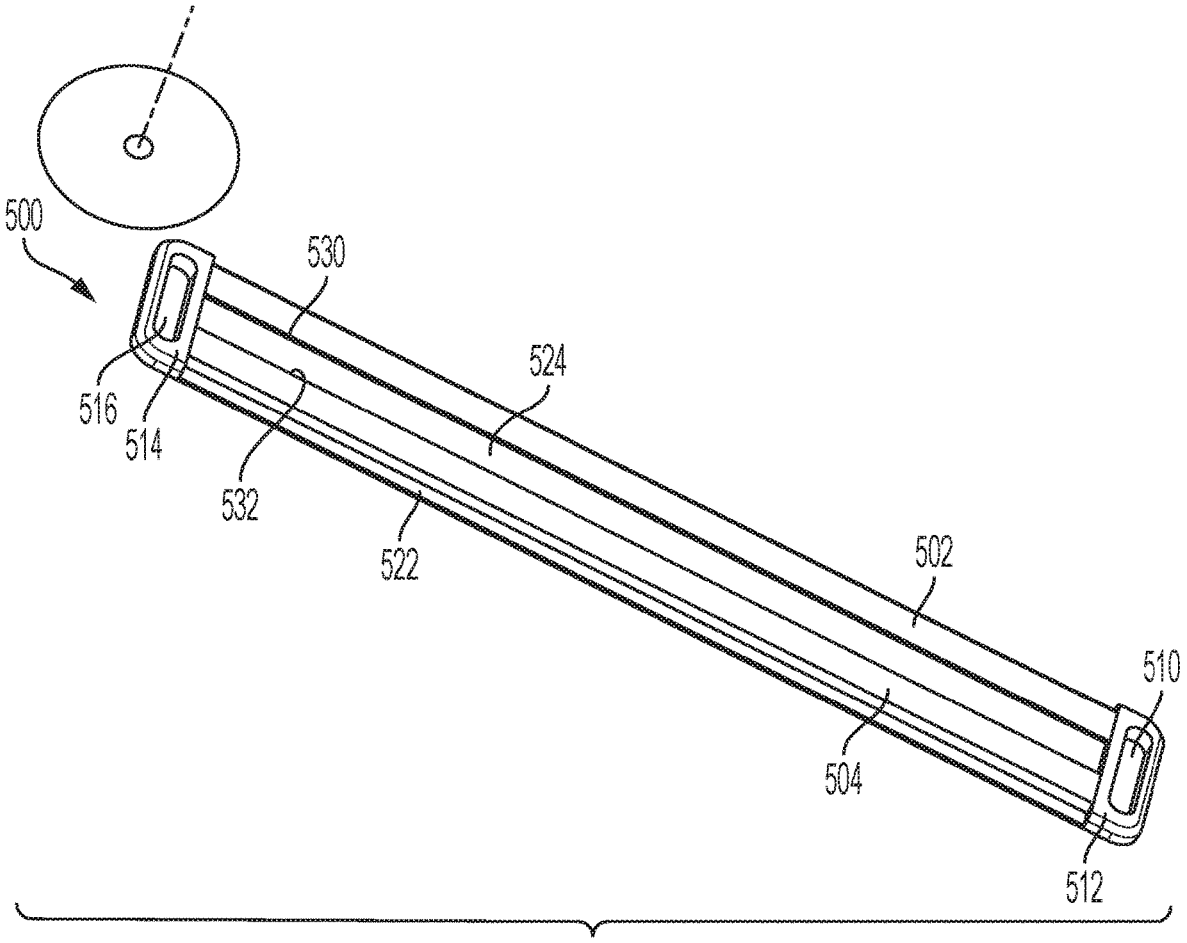
Figure 6:
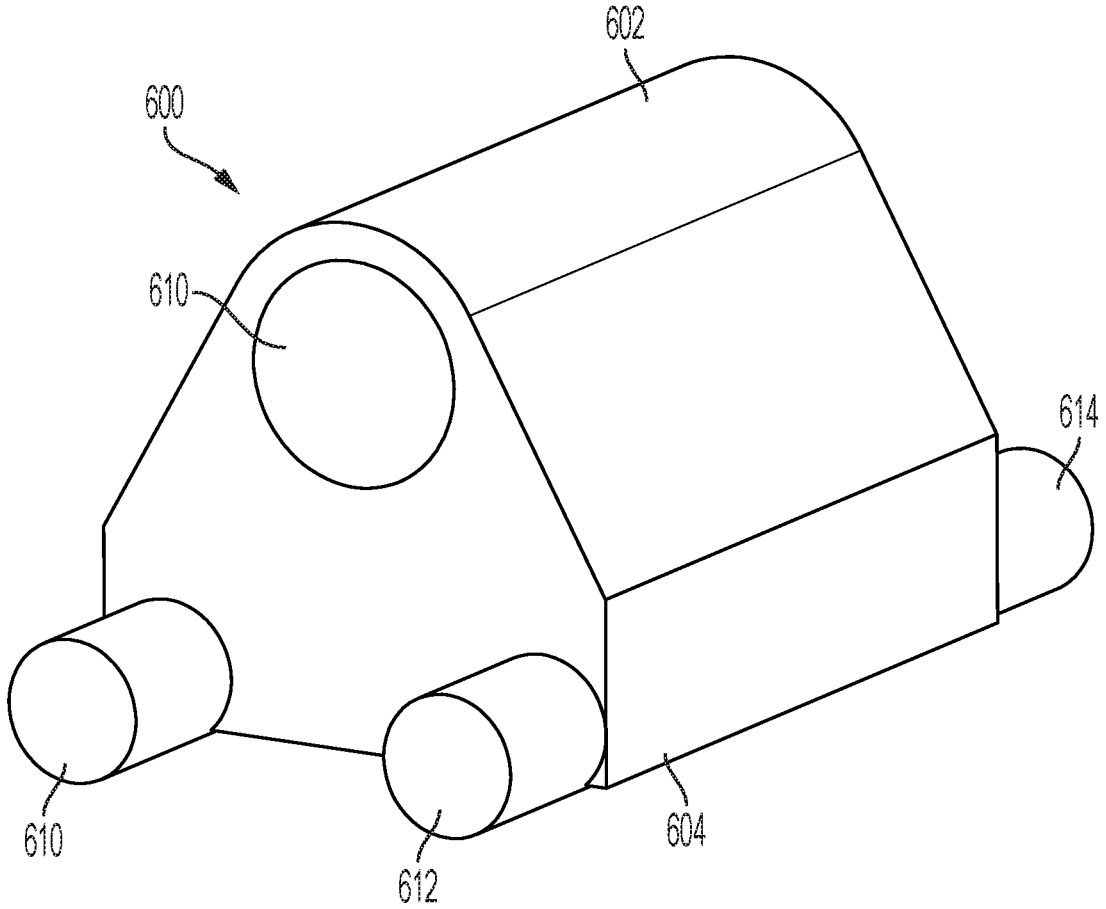
FIG. 6 shows a perspective view of a sled according to embodiments of the invention.

FIG. 4 shows a perspective view of the housing 400 for the rehabilitation apparatus 100. FIG. 5A shows a top view of the base 500 for the rehabilitation apparatus 100 and FIG. 5B shows a perspective view of the base 500 for the rehabilitation apparatus 100. FIG. 6 shows a perspective view of the sled 600 for the rehabilitation apparatus 100. In conjunction with the slider wheels (not shown), these components enable the full range of motion for the user's knee. The housing 400 has a top side 402 and a bottom side 404. The top side 402 comprises a surface for the user to sit on or near during the exercises. The bottom side 404 is placed on a horizontal surface for support of the user during the exercises. The housing 400 includes a ledge 406 that has four bosses or protrusions 410, 412, 414, and 416. Boss 410 is on the right side of the housing 400 and boss 416 is on the left side of the housing 402. Bosses 412 and 414 are in the interior of the ledge. These bosses 410, 412, 414, and 416 may be used to connect to the base 500.

The base 500 provides a long pathway for the sled 600 and the slider wheels (not shown) to traverse during the exercises. The base 500 includes a first rail 502 on the right side of the base 500 and a second rail 504 on the left side of the base 500. A right outer surface 520 and a left outer surface 522 are located exterior to the first rail 502 and the second rail 504. And an inner surface 524 is located in between the first rail 502 and the second rail 504. The first rail 502 and second rail 504 are thicker and have a higher profile than the outer surfaces 520, 522 and the inner surface 524. A first raised edge 512 defines a side of the base 500 that will be connected to the housing 400 and a second raised edge 514 defines a side of the base 500 that is distant from the housing 400. The first raised edge 512 has one or more apertures or voids 510 for connection to the housing 400. The second raised edge 514 may also have one or more apertures or voids 516. In some embodiments, both raised edges 512, 514 have apertures that can be connected to the housing 400.

FIGS. 4, 5A, and 5B show that the housing 400 may be connected to the base 500 by inserting the bosses 410, 412 into the one or more apertures 510. The housing 400 may also be connected to the base 500 by inserting the bosses 414, 416 into one or more apertures 510. This way the rehabilitation apparatus 100 can be used for the user's right or left leg. If bosses 410, 412 are used, then the user may be exercising his or her right leg, and if bosses 414, 416 are used, then the user may be exercising his or her left leg. Many different options for connecting the base 500 to the housing 400 are within the scope of the present invention, but this option gives the user the ability to adjust the apparatus 100 for use with the right leg or the left leg. In some embodiments, the base 500 is permanently connected to the housing 400.

The sled 600 includes an upper surface 602 and a lower surface 604. The lower surface 604 of the sled 600 is adjacent to the inner surface 524 during operation. This enables the sled to move along the base 500. A hole or aperture 610 may be designed to hold the thigh support link 110 (not shown). This way the thigh support link 110 moves in conjunction with the sled 600. The sled 600 further comprises four bosses or protrusions 610, 612, 614. These bosses 610, 612, 614 may fit within a first ledge 530 and a second ledge 532 of the base 500. The first ledge 530 is a portion of the first rail 502 that creates a cavity for the sled 600, and the second ledge 532 is a portion of the second rail 504 that creates a cavity for the sled 600. Accordingly, bosses 610, 612 may fit into the first ledge 530, and bosses 614 (one boss not shown) may fit into the second ledge 532. This configuration or connection enables the sled 600 to traverse the base 500 by sliding along the inner surface 524, which enables the thigh support link 110 to move and achieve the full range of motion. Many different options for connecting the sled 600 or a different component to the base 500 are within the scope of the present invention.

The slider wheels (see FIGS. 1 and 2) are designed to roll along the right outer surface 520 and the left outer surface 522. This configuration enables the slider wheels 142, foot plate 130, and connected lower leg link 114 to traverse the base 500 by rolling along the right and left outer surfaces 520, 522. Many different options for allowing the slider wheels 142 or a different component to roll or slide along the base 500 are within the scope of the present invention. During extension of the knee, the slider wheels are farther away from the housing 400 than during flexion. In some embodiments, the slider wheels are internal or housed within the apparatus 100.

Figure 7A:
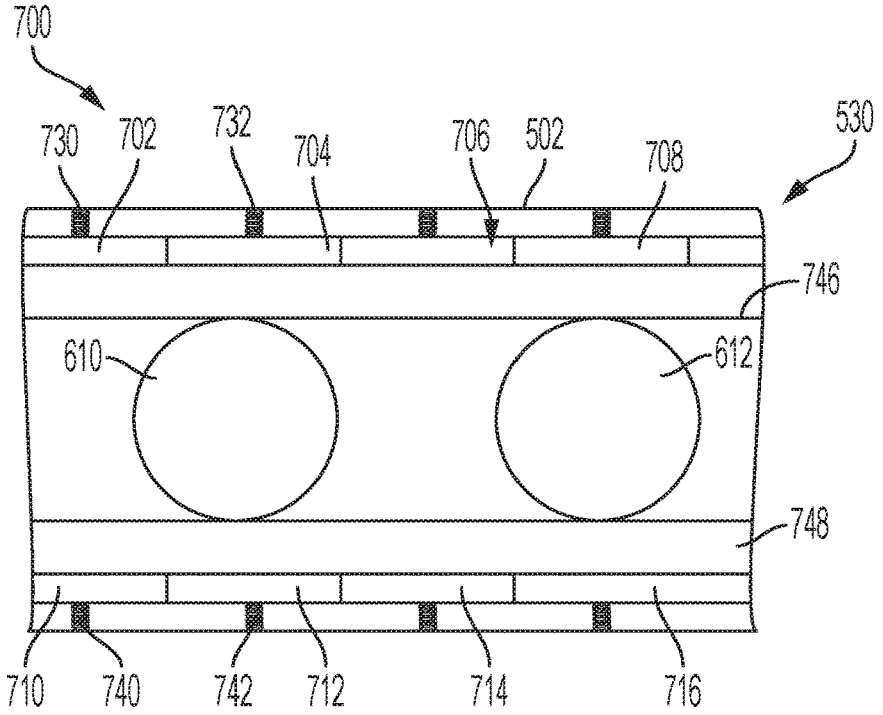
FIG. 7A shows a method for providing magnetic resistance according to embodiments of the invention.

FIG. 7A shows a method for providing magnetic resistance to the rehabilitation apparatus 100. This view is taken from inside the first ledge 530 inside the first rail 502 of the base 500. As discussed above, the sled (not shown) moves along the inner surface 524 of the base 500. Bosses 610 and 612 of the sled fit within a top edge 746 and a bottom edge 748 for controlling the movement of the sled. Upper magnets 702, 704, 706, 708 are placed between the surface of the first rail 502 and the top edge 746 and lower magnets 710, 712, 714, 716 are placed between the bottom of the base 500 and the bottom edge 748. Spring or lift mechanisms 730, 732 are then used to push the upper magnets 702, 704, 706, 708 closer to the bosses 610, 612 or further away. Spring or lift mechanisms 740, 742 are then used to push the lower magnets 710, 712, 714, 716 closer to the bosses 610, 612 or further away. The upper and lower magnets may be oppositely charged to create the desired magnetic field. By placing oppositely-charged magnets or metal that are attracted to magnets on the sled, the sled becomes more or less attracted to the upper and lower magnets depending on the distance from the magnets. In this embodiment, the magnets could be strategically placed on the bosses or on other parts of the sled to achieve the desired adjustable resistance. Additionally, the upper and lower magnets can increase or decrease the magnetic field between them by moving closer together or further away, which could also affect the resistance applied to the sled as it moves along the base. As the magnetic field that the sled moves in changes, so does the resistance. This system may provide a consistent resistance throughout the length of the base as the sled moves through this magnetic field. In other embodiments, the resistance may be applied to slider wheels or other similar components that are attached to the foot plate instead of or in addition to the resistance applied to the sled or in addition to the resistance applied to the sled.

Figure 7B:
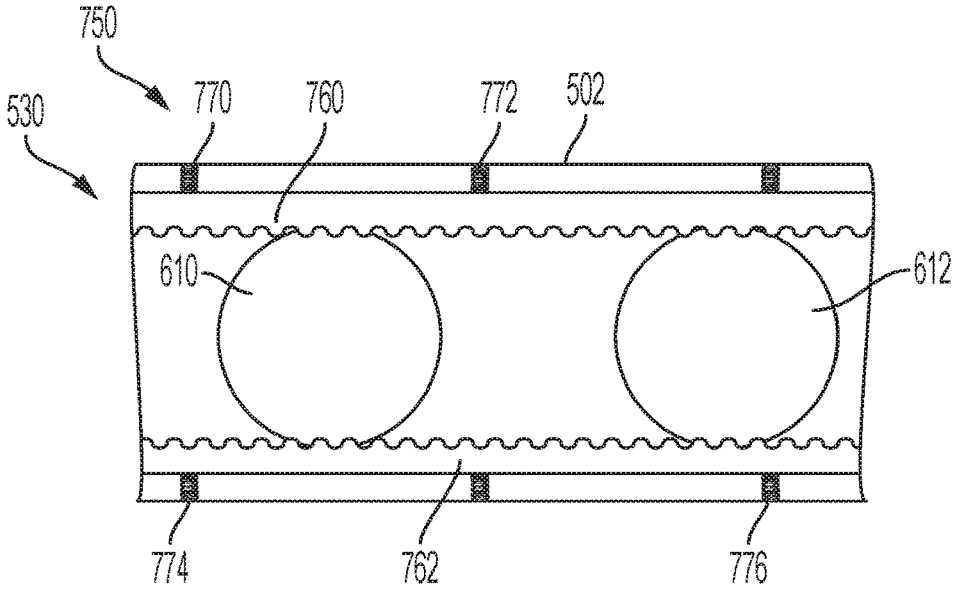
FIG. 7B shows a method for providing direct resistance according to embodiments of the invention.

FIG. 7B shows a method for providing direct resistance to the rehabilitation apparatus 100. This view is taken from inside the first ledge 530 inside the first rail 502 of the base 500. The bosses 610, 612 are shown in FIG. 7B between the top of the first rail 502 and the bottom of the base 500. Upper surface or plastic pad 760 contacts the top side of the bosses 610, 612 and lower surface or plastic pad 762 contacts the bottom side of the bosses 610, 612. Spring or lift mechanisms 770, 772 are then used to push the upper surface or plastic pad 760 closer to the bosses 610, 612 or further away. Spring or lift mechanisms 774, 776 are then used to push the lower surface or plastic pad 762 closer to the bosses 610, 612 or further away. As the brush or pads 760, 762 contact more and more of the bosses 610, 612 more resistance is felt by the user. This concept is similar to a flywheel on an exercise bike. More friction is created as the surface, brush, or plastic pads further contact the bosses 610, 612. Similarly, this system may provide a consistent resistance throughout the length of the base. In other embodiments, the resistance may be applied to slider wheels or other similar components that are attached to the foot plate instead of the resistance applied to the sled or in addition to the resistance applied to the sled. The rehabilitation apparatus may include a digital display or a mechanical mechanism for adjusting the direct or magnetic resistance.

Figure 8:
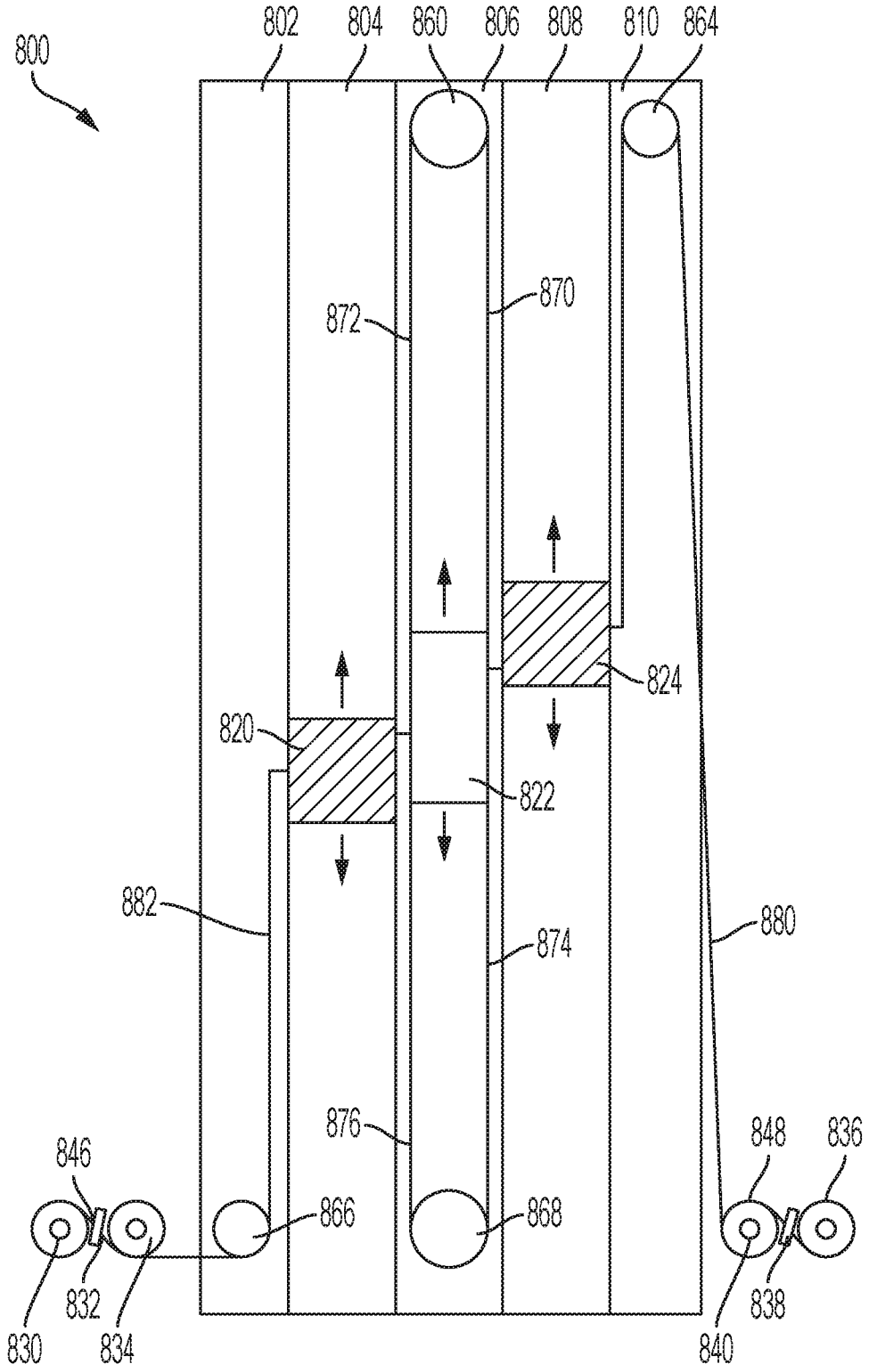
FIG. 8 shows a rehabilitation apparatus for providing magnetic resistance according to embodiments of the invention.

FIG. 8 shows a rehabilitation apparatus 800 providing magnetic resistance according to a preferred embodiment of the present invention. Some components, such as the foot plate, the lower leg link, the upper leg link, and the thigh support link are not shown in this figure. Conventional rehabilitation machines and apparatuses either do not provide resistance or only provide resistance in one direction. For example, resistance may be provided for extension but not for flexion, or for flexion but not for extension. One advantage of the present invention is that resistance can be provided in both directions—extension and flexion. This resistance is also customized and specific for each range of motion for the patient. In this embodiment 800, magnetic resistance can be used. A base with a first rail 804 and a second rail 808 is shown, although ledges for the first rail 804 and second rail 808 are not shown. The base also has a first outer surface 802, second outer surface 810, and an inner surface 806. As discussed above, slider wheels (not shown) may traverse the first outer surface 802 and the second outer surface 810, while a sled 822 may traverse the inner surface 806. The sled 822 may traverse the inner surface 806 to move the thigh support link (not shown). A first slider 820 and a second slider 824 may be connected to the sled 822. During operation, the first slider 820 may travel under the first rail 804 with the sled 822, while the second slider may travel under the second rail 808 with the sled 822. The first slider 820, the sled 822, and the second slider 824 move towards the top of the base during extension and move towards the bottom of the base during flexion.

A first inner pulley wheel 860 and a second inner pulley wheel 868 are connected to the sled 822. Upper left band or wire 872 and upper right band or wire 870 connect the sled 822 to the first inner pully wheel 860, and lower left band or wire 876 and lower right band or wire 874 connect the sled 822 to the second inner pulley wire 874. All of these pulley bands or wires 872, 870, 874, 876 are connected to circle both pulley wheels 860, 868. This way the sled 822 can move up and down the base smoothly. In one embodiment, only the left side bands or wires 872, 876 are connected to the sled 822 to enable the full range of motion. Bands, wires, or other types of sliders can be used to enable the movement of the sled 822 up and down the inner surface of the base. In some embodiments, the sled 822 may be able to traverse the base without this pulley or band system.

A first b-motor that consists of a first spool 830, a second spool 834, and a first magnetic clamp or compression component 832 control the magnetic resistance for extension by the user. A second b-motor that consists of a third spool 836, a fourth spool 840, and a second magnetic clamp or compression component 838 control the magnetic resistance for extension by the user. The first spool 830 and the second spool 834 are connected by a metallic or magnetic band 846 that reacts with the first magnetic clamp 832. The third spool 836 and the fourth spool 840 are connected by a metallic or magnetic band 848 that reacts with the second magnetic clamp 838. Both magnetic clamps 832, 838 include strong magnets that can be adjusted to be closer or further away from the metallic or magnetic bands 846, 848 to adjust the magnetic resistance. This feature will be discussed further with reference to FIG. 9.

A first outer pulley wheel 866 connects the second spool 834 to an outer band 882 that is connected to the first slider 820. Thus, movement of the first slider 820 can be controlled by the second spool 834. A second outer pulley wheel 864 connects the fourth spool 840 to an outer band 880 that is connected to the second slider 824. The first outer pulley wheel 866 is located at the bottom of the base, while the second outer pulley wheel 864 is located at the top of the base. Outer band 882 provides resistance for the first slider 820 as it travels to the top of the base (extension), and outer band 880 provides resistance for the second slider 824 as it travels to the bottom of the base (flexion). In this configuration, the magnetic clamp 832 can move its internal magnets closer together to provide additional resistance to the metallic or magnetic band 846 and second spool 834 as it allows outer band 882 to extend during the extension range of motion. Similarly, the magnetic clamp 838 can move its internal magnets closer together to provide additional resistance to the metallic or magnetic band 848 and fourth spool 840 as it allows outer band 880 to extend during the flexion range of motion. One motor is used for the extension range of motion and one motor is used for the flexion range of motion. Thus, magnetic resistance controls both the extension and flexion ranges of motion. In a preferred embodiment, this magnetic resistance is adjustable and since there are two separate motors the magnetic resistance for extension does not have to match the magnetic resistance for flexion. The user can select separate resistances for extension and flexion. In some embodiments, exercise bands or tubing can assist with the resistance required.

Figure 9:
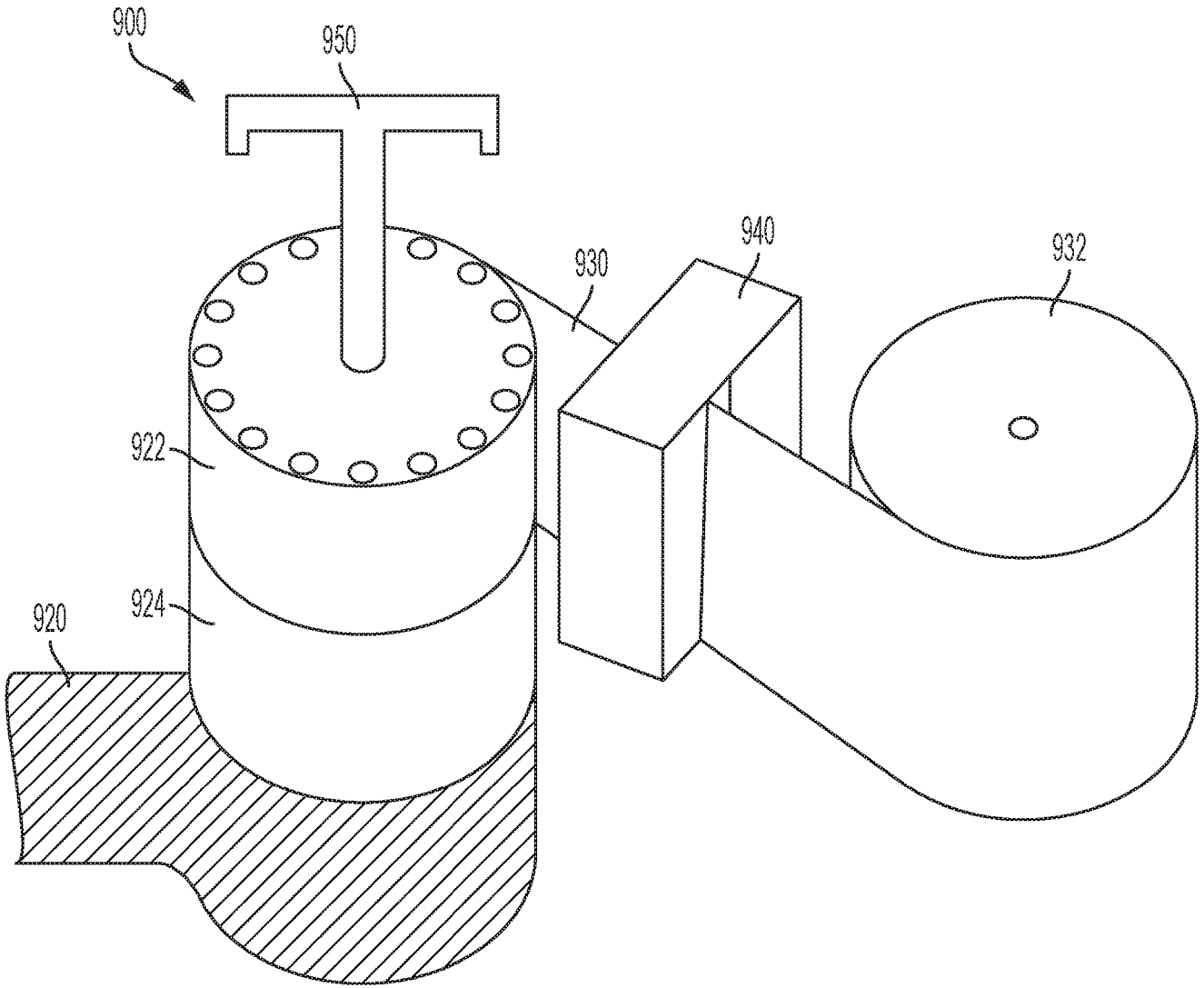
FIG. 9 shows a rehabilitation apparatus for providing magnetic resistance according to embodiments of the invention.

FIG. 9 shows a motor for a rehabilitation apparatus that provides magnetic resistance according to some embodiments of the present invention. FIG. 9 illustrates an exploded view of a b-motor similar to the motors shown in FIG. 8. A first spool 932 holds a first band 930 that is connected to a second spool 922. The band may be a metallic or magnetic band that reacts to a magnetic field. As the rehabilitation apparatus moves from extension to flexion, this band 930 wraps around the first spool 932 and second spool 922 according to the distance traveled by foot plate (not shown) or sled (not shown). At full extension, the band 930 may be more wrapped around the second spool 922, while the band 930 may be more wrapped around the first spool 932 at full flexion. The second spool 922 is connected to a third spool 924 that controls a second band 920 that feeds into the pulley or band system described with reference to FIG. 8. As the third spool 924 turns the second spool 922 turns, and the first band 930 and the second band 920 move accordingly. In this way the b-motor system controls the movement of the rehabilitation apparatus.

Magnetic resistance is provided by a magnetic compression component or clamp 940. This magnetic compression component 940 has at least two magnets to create a magnetic field that surrounds the first band 930. In some embodiments, at least one magnet is on the left side of the first band 930 and at least one oppositely-charged magnet is on the right side of the first band 930 creating a magnetic field. Thus, the first band 930 must travel through the magnetic compression component 940 as it winds or unwinds around the first spool 932 and the second spool 922. In a preferred embodiment, the magnetic resistance is adjustable through this magnetic compression component 940. This can be done by moving the magnet(s) on the left side and the magnet(s) on the right side closer together or further apart. When the magnets are closer together a stronger magnetic field is created, which depending on the composition or charge on the band could make it more difficult or less difficult to travel through said magnetic field. The resistance would be constant as the band moves through the same magnetic field. The magnets of the magnetic compression component 940 could be moved together or further away by a spring or mechanical mechanism. The rehabilitation apparatus may include a digital display, input panel, or a mechanical mechanism for adjusting the resistance.

In some embodiments, a t-bar mechanism 950 can attach to the second spool 922 to enable the user to assist in turning the second spool 922. The user could use the t-bar mechanism 950 to assist with the exercises if they become difficult at that resistance.

Figure 10B:
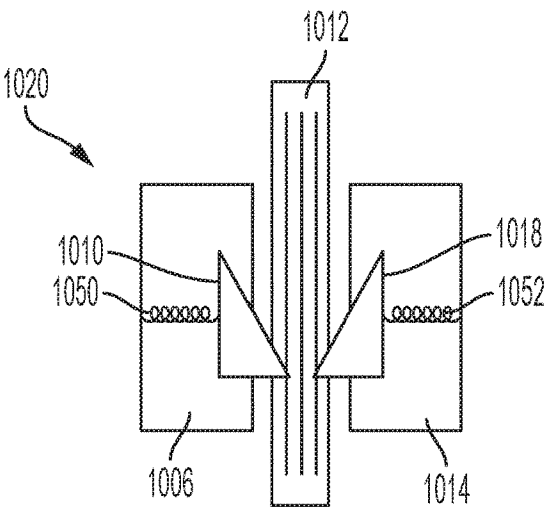
FIGS. 10A and 10B show a rehabilitation apparatus for providing magnetic resistance according to embodiments of the invention.
Figure 10A:
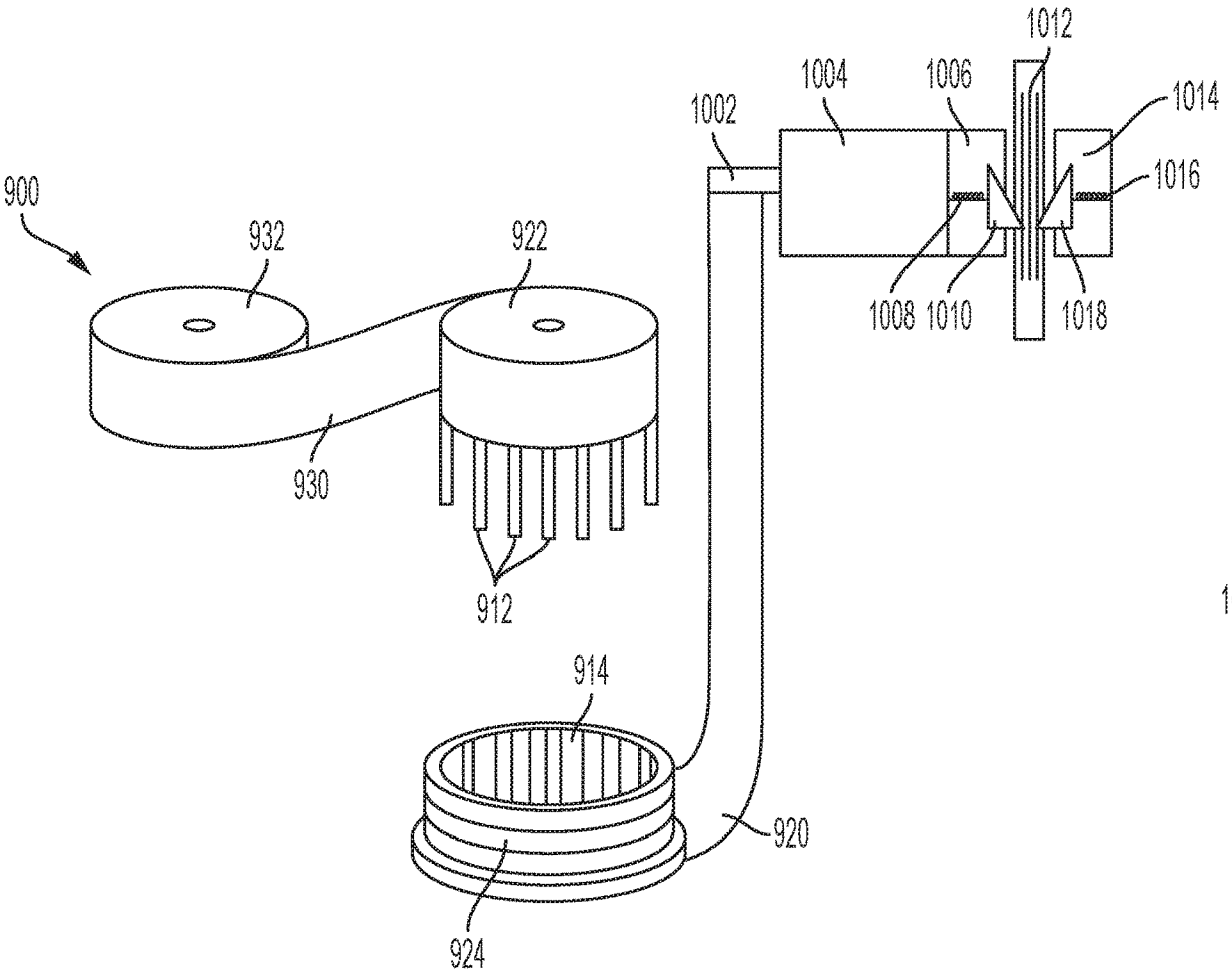

FIGS. 10A and 10B further illustrate the rehabilitation apparatus for providing magnetic resistance according to some embodiments of the present invention. First spool 932 and second spool 922 are connected by the first band 930. The magnetic compression component is not shown in FIG. 10A. The third spool 924 is connected to the second spool 922 through a connection mechanism. In FIG. 10A, the connection mechanism consists of teeth or protrusions 912 and apertures or slots 914, but the present invention covers other connection mechanisms as well. When connected together, the second spool 922 and the third spool 924 enable the second band 920 to extend and contract as the rehabilitation apparatus moves from extension to flexion.

The second band 920 connects to a first slider 1004 through a finger 1002 that allows the second band 920 to move in conjunction with the first slider 1004. The first slider 1004 of FIG. 10A is different than the first slider 820 of FIG. 8 due to its connections to the pulley or band system and the sled. In this embodiment, the first slider 1004 connects to an exchange system 1020 where the transfer from extension to flexion can be accomplished. More specifically, when the user completes the extension movement through the resistance applied by one b-motor, the rehabilitation apparatus must transfer or exchange to the other b-motor for the flexion movement. The exchange system 1020 of FIGS. 10A and 10B is only one embodiment and the present invention is not limited to this embodiment. The first slider 1004 is connected to a first housing 1006 that includes a spring mechanism 1008 and a triangle 1010. A second slider (not shown) is connected to a second housing 1014 that includes a spring mechanism 1016 and a triangle 1018. As the first slider 1004 and the second slider (not shown) move up and down an inner surface or rail 1012 the first housing 1006 and the second housing 1014 will align at the top of the user's leg extension. This may cause the first triangle 1010 and the second triangle 1018 to contact or lock into place. This way the rehabilitation apparatus can transfer or exchange from the extension movement to the flexion movement wherein the other b-motor takes over as the second slider (not shown) moves downward.

FIG. 10B further illustrates spring mechanism 1050 and spring mechanism 1052 that may operate to transfer or exchange from one b-motor to the other. Specifically, as the first triangle 1010 moves upward toward the end of the extension movement, it contacts the second triangle 1018, which engages the second slider (not shown) and disengages the first slider 1004. This exchange system 1020 may be connected to the b-motors to turn on and off the magnetic resistance applied to the rehabilitation apparatus. In some embodiments, the engagement or disengagement of the first triangle 1010 and the second triangle 1018 is electrically connected to the b-motors and the magnetic compression component 940 to turn on and off the resistance. This way one b-motor provides magnetic resistance for the extension movement and the other b-motor provides magnetic resistance for the flexion movement.

In other embodiments, this transfer and exchange system can include alternating sliders or components that move separately. One slider or component connected to a first b-motor moves during extension and a separate slider or component connected to a second b-motor moves during flexion. The transfer and exchange system could also include a mechanism for turning on and off the b-motors in response to the range of movement of the patient. At full extension, one b-motor turns off, while the other b-motor turns on. The present invention includes alternative transfer and exchange systems.

In some embodiments, a single b-motor or other type of motor could provide the magnetic resistance needed. For example, the magnetic compression components could provide adjustable magnetic resistance to a band that can travel in both directions. The magnetic resistance would be applied for both ranges of motion. Adjustments to the resistance applied for each range of motion could be handled through electronic means. A transfer or exchange system would be required to reverse the movement of the band through the b-motor.

In other embodiments, a flywheel or a brake-based resistance system may be used to provide the desired resistance. The flywheel could control the adjustable resistance on a circular band, chain, or track system. This flywheel system could then be attached to first slider, sled, and/or second slider to move in conjunction with the user during the extension and flexion movements. Similar to the b-motor system above, the circular system could be connected to a gear that enables the slider and/or sled to move up and down the base of the rehabilitation apparatus. As the sled moves, the band travels around the circular system and goes through the flywheel which can provide direct or magnetic resistance. Adjusting the flywheel will adjust the resistance on the band, and thus, provide the continuous, consistent resistance to the sled. As discussed above, two flywheel and circular systems may be required (one for extension and one for flexion). The user could adjust the resistance of the rehabilitation apparatus by adjusting the resistance in the flywheel.

In another embodiment, magnetic hysteresis clutch components may be used to provide the resistance. For example, the magnetic clutch Magtork Model MTL5-3/8 from Magnetic Technologies Ltd. may be used to provide adjustable resistance. Similar to the configuration disclosed above, two magnetic clutch components may be used—one for extension and one for flexion. Each magnetic clutch is connected to a spindle (first and second spindles) and is located on opposite sides of the base (left and right). The magnetic clutches may be close to the user or at the far end of the base according to alternate configurations. Third and fourth complementary spindles are located at the opposite end of the base, wherein a belt or band connects the complementary spindles together (first connected to third spindle and second connected to fourth spindle). The first belt traverses the right side of the base and the second belt traverses the left side of the base.

Similar to the sliders discussed above, a carriage may be connected to each belt in the middle of the two belts. This carriage may be connected to the foot plate or the sled to control the movement of the user's leg up and down the base of the rehabilitation apparatus. The carriage is connected to both belts to move in conjunction with the belts. As the carriage is pushed forward (extension), the right belt turns the corresponding right magnetic clutch to impart a forward force (can be adjustable). The left belt does not engage the left magnetic clutch because of a slip bearing on the spindle. Thus, no force is being applied on the left belt during the forward (extension) movement. When the carriage direction is reversed (flexion), the right belt slips and the right magnetic clutch disengages. The left belt engages the left magnetic clutch during this flexion movement to impart a reverse force (can be adjustable). During this movement, no force is being applied to the right belt. The user may adjust the right and left magnetic clutches to impart adjustable resistance during the extension and flexion movements. The user may select the right magnetic clutch to be at a higher resistance than the left magnetic clutch, which will provide higher resistance for the extension movements. In this embodiment, two belts are used, and the slip bearings allow the engagement and disengagement of the corresponding spindles.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A rehabilitation apparatus, said apparatus comprising:

a leg support that is configured for supporting a user's leg and is connected to a foot support; and said foot support that is configured for supporting a user's foot;

wherein said foot support is configured to travel in a first direction and in a second direction that is substantially opposite of the first direction;

wherein said apparatus is configured to apply a first resistance that is substantially consistent to said foot support as it travels in said first direction in response to a first setting through a first magnetic motor and is configured to apply a second resistance that is substantially consistent to said foot support as it travels in said second direction in response to a second setting through a second magnetic motor;

wherein said apparatus is configured to control a passive motion of said foot support as it travels in said first direction in response to a third setting.

2. The rehabilitation apparatus of claim 1, wherein said apparatus is configured to apply a first resistance that is substantially consistent as said leg support travels along said base in said first direction.

3. The rehabilitation apparatus of claim 2, wherein said apparatus is configured to apply said second resistance that is substantially consistent as said leg support travels along said base in said second direction.

4. The rehabilitation apparatus of claim 1, wherein said first resistance may be different than said second resistance.

5. The rehabilitation apparatus of claim 1 wherein said apparatus is configured to control a passive motion of said foot support as it travels in said second direction in response to a fourth setting.

6. The rehabilitation apparatus of claim 5, wherein said first resistance is configured to be substantially consistent as said leg support travels in said first direction.

7. The rehabilitation apparatus of claim 6, wherein said second resistance is configured to be substantially consistent as said leg support travels in said second direction.

8. The rehabilitation apparatus of claim 5, further comprising at least one b-motor that is configured to control said first resistance and said second resistance in response to said first setting and said second setting.

9. The rehabilitation apparatus of claim 5, further comprising at least one first b-motor that is configured to control said first resistance in response to said first setting.

10. The rehabilitation apparatus of claim 9, further comprising at least one second b-motor that is configured to control said second resistance in response to said second setting.

11. The rehabilitation apparatus of claim 10, further comprising a transfer mechanism that is configured to activate said first b-motor when said leg support travels in said first direction and to activate said second b-motor when said leg support travels in said second direction.

12. The rehabilitation apparatus of claim 5, further comprising at least one first magnetic clutch that is configured to control said first resistance in response to said first setting and at least one second magnetic clutch that is configured to control said second resistance in response to said second setting.

13. The rehabilitation apparatus of claim 12, further comprising a transfer mechanism that is configured to activate said first magnetic clutch when said leg support travels in said first direction and to activate said second magnetic clutch when said leg support travels in said second direction.

14. The rehabilitation apparatus of claim 5, wherein said first resistance and said second resistance are adjustable and wherein said input panel is configured to enable selection of a different value for said first resistance than said second resistance.

15. The rehabilitation apparatus of claim 1, wherein said first resistance and said second resistance are enabled to be controlled by the user through a display panel.

16. The rehabilitation apparatus of claim 15, wherein said display panel is configured to enable a user to select a different value for said first resistance than said second resistance.

17. The rehabilitation apparatus of claim 15, wherein said display panel is further configured to control at least one motor that is configured to provide said passive motion of said foot support.

18. The rehabilitation apparatus of claim 1, further comprising a transfer mechanism that is configured to activate said first magnetic motor when said leg support travels in said first direction and to activate said second magnetic motor when said leg support travels in said second direction.

* * * * *